US011879637B1

(12) United States Patent
Choi

(10) Patent No.: US 11,879,637 B1
(45) Date of Patent: Jan. 23, 2024

(54) GAS MIXING APPARATUS FOR BOILER

(71) Applicant: Jin Min Choi, Seoul (KR)

(72) Inventor: Jin Min Choi, Seoul (KR)

( * ) Notice: Subject to any disclaimer, the term of this patent is extended or adjusted under 35 U.S.C. 154(b) by 0 days.

(21) Appl. No.: 18/337,503

(22) Filed: Jun. 20, 2023

(30) Foreign Application Priority Data

Dec. 16, 2022 (KR) ..... 10-2022-0176450

(51) Int. Cl.
*F23D 14/62* (2006.01)

(52) U.S. Cl.
CPC ..... *F23D 14/62* (2013.01)

(58) Field of Classification Search
CPC ..... F23D 14/62; F23D 14/70
USPC ..... 137/888
See application file for complete search history.

(56) References Cited

U.S. PATENT DOCUMENTS 141,361 A * 7/1873 Korting ..... B01F 25/31242 417/174
333,086 A * 12/1885 Strickland ..... F04F 5/46 417/151
4,123,800 A * 10/1978 Mazzei ..... B01F 25/4336 366/181.5
4,333,833 A * 6/1982 Longley ..... C02F 1/686 423/DIG. 9
4,587,809 A * 5/1986 Ohmori ..... B01F 25/3131 60/737
4,721,126 A * 1/1988 Horii ..... F15D 1/0015 137/888
4,872,833 A * 10/1989 Kramer ..... B01F 25/3121 431/354
5,489,203 A * 2/1996 Dobbeling ..... F23D 14/62 431/284
5,515,680 A * 5/1996 Fujimura ..... F23D 14/62 60/737
7,993,130 B2 * 8/2011 Lewin ..... F23C 9/08 126/91 A
10,378,760 B2 * 8/2019 Rousseau ..... F23N 1/002
(Continued)

FOREIGN PATENT DOCUMENTS

JP 2012-145114 A 8/2012
KR 10-2019-0077904 A 7/2019
KR 10-2022-0075486 A 6/2022

OTHER PUBLICATIONS

"Request for the Submission of an Opinion" Office Action issued in KR 10-2022-0176450; mailed by the Korean Intellectual Property Office dated Jan. 7, 2023.

(Continued)

*Primary Examiner* — Umashankar Venkatesan
(74) *Attorney, Agent, or Firm* — Studebaker & Brackett PC

(57) ABSTRACT

The present disclosure relates to a gas mixing apparatus for a boiler, and the gas mixing apparatus includes a housing provided in the form of a hollow pipe opened at upper and lower sides thereof and having a first gas inlet port through which fuel gas is introduced from the outside, and a mixing pipe including a pipe body provided in the housing and configured to allow air to flow therein, the mixing pipe having a second gas inlet port provided at a lateral side of the mixing pipe and configured to allow the fuel gas to be introduced therethrough, and fluid guides provided at an outer side of the pipe body and configured to guide a flow of the fuel gas from the first gas inlet port to the second gas inlet port.

10 Claims, 8 Drawing Sheets

(56) References Cited

U.S. PATENT DOCUMENTS

| | | | | |
|---|---|---|---|---|
| 2002/0006591 | A1* | 1/2002 | Hugens, Jr. | F23D 14/62 431/354 |
| 2021/0394134 | A1* | 12/2021 | Miura | B01F 23/10 |
| 2022/0106209 | A1* | 4/2022 | Zhou | B01J 8/08 |

OTHER PUBLICATIONS

"Written Decision on Registration" Office Action issued in KR 10-2022-0176450; mailed by the Korean Intellectual Property Office dated May 3, 2023.

* cited by examiner

GAS MIXING APPARATUS FOR BOILER

CROSS-REFERENCE TO RELATED APPLICATIONS

This application claims benefit and priority to Korean Patent Application No. 10-2022-0176450, filed on Dec. 16, 2022, with the Korean Intellectual Property Office, the disclosure of which is incorporated herein in its entirety by reference.

TECHNICAL FIELD

The present disclosure relates to a gas mixing apparatus for a boiler, and more particularly, to a gas mixing apparatus for a boiler that mixes fuel gas with air in advance before the fuel gas is supplied to a combustion part of a boiler.

BACKGROUND

Depending on the types of fuel to be used, boilers may be classified into a gas boiler, an oil boiler, a briquette boiler, a firewood boiler, an electric boiler, an electric vapor boiler, and the like. Among the boilers, the gas boiler is widely used because the gas boiler is easy to use and is advantageous in reducing environmental pollution because the gas boiler uses gas that is clean fuel.

The gas boiler receives fuel gas and air from the outside, mixes the fuel gas and the air, supplies the mixed gas to a burner, and then combusts the mixed gas by igniting the mixed gas. Fuel gas and air need to be mixed smoothly to improve combustion efficiency.

The gas boiler is equipped with a gas mixing apparatus for mixing fuel gas and air. An example of the gas mixing apparatus in the related art is disclosed in Korean Patent Application Laid-Open No. 10-2022-0075486 (hereinafter, referred to as a 'patent document') entitled 'Venturi Device for Gas Boiler'.

The gas mixing apparatus according to the patent document includes a housing and a mixing pipe. The housing has a hollow shape opened at upper and lower sides thereof, and a gas inlet port is formed at a lateral side of the housing. The mixing pipe is provided in the housing and has a hollow shape opened at upper and lower sides thereof. An air inlet hole is formed at a lower end of the mixing pipe, and a gas inlet port is formed at a lateral lower side of the mixing pipe.

According to the gas mixing apparatus according to the patent document, air is introduced into the mixing pipe through the lower end of the mixing pipe, and fuel gas is introduced between the housing and the mixing pipe through the gas inlet port of the housing and then introduced into the mixing pipe through the gas inlet port of the mixing pipe. A gas mixture is formed by mixing fuel gas and air in the mixing pipe, and the gas mixture is discharged to the burner of the boiler through an upper-end discharge hole of the mixing pipe.

In the gas mixing apparatus according to the patent document that has the above-mentioned structure, a flow of fuel gas is not stable, during a process in which the fuel gas is introduced between the housing and the mixing pipe through the gas inlet port of the housing and then introduced into the mixing pipe through the gas inlet port of the mixing pipe.

That is, the flow of the fuel gas is dispersed without being concentrated between the housing and the mixing pipe, such that the flow of the fuel gas introduced into the mixing pipe is not smooth. For this reason, fuel gas and air cannot be smoothly mixed in the mixing pipe, and combustion efficiency of the burner also deteriorates.

[Document of Related Art]

[Patent Document]

(Patent Document 001) Korean Patent Application Laid-Open No. 10-2022-0075486 (published on Jun. 8, 2022)

SUMMARY

The present disclosure has also been made in an effort to provide a gas mixing apparatus for a boiler, which is capable of smoothly mixing fuel gas and air.

An embodiment of the present disclosure provides a gas mixing apparatus for a boiler, the gas mixing apparatus including: a housing provided in the form of a hollow pipe opened at upper and lower sides thereof and having a first gas inlet port through which fuel gas is introduced from the outside; and a mixing pipe including: a pipe body provided in the housing and configured to allow air to flow therein, the mixing pipe having a second gas inlet port provided at a lateral side of the mixing pipe and configured to allow the fuel gas to be introduced therethrough; and fluid guides provided at an outer side of the pipe body and configured to guide a flow of the fuel gas from the first gas inlet port to the second gas inlet port.

The first gas inlet port may be positioned at a higher position than the second gas inlet port.

The pipe body may be disposed at an interval from an inner surface of the housing.

The fluid guides may include: a plurality of first fluid guides protruding from an outer surface of the pipe body, elongated in an upward/downward direction, spaced apart from one another, and configured to guide a flow of fuel gas downward; and second and third fluid guides respectively provided at upper and lower sides of a contact portion of the outer surface of the pipe body with which fuel gas introduced through the first gas inlet port primarily comes into contact, the second and third fluid guides being configured to guide a flow of the fuel gas so that the flow of the fuel gas is inclined downward.

The second gas inlet port may be provided at a lateral lower side of the pipe body and provided between the first fluid guides.

The second and third fluid guides may each have downward inclined guide surfaces provided at two opposite sides thereof.

The second and third fluid guides may be integrated with the first fluid guide and the pipe body with the first fluid guide interposed therebetween.

The mixing pipe may further include gap maintaining parts protruding from an outer surface of the pipe body and spaced apart from each other at an interval in an upward/downward direction, and the gap maintaining parts may maintain an interval between the pipe body and an inner side of the housing.

An O-ring fitting groove may be formed at an end of the gap maintaining part, and an O-ring, which is in close contact with the inner surface of the housing, may be fitted into the O-ring fitting groove.

The first and second gas inlet ports may be positioned between the gap maintaining parts.

According to the gas mixing apparatus for a boiler according to the present disclosure, a flow of fuel gas is formed to a center of a flow of air while surrounding the flow of air by 360 degrees when the fuel gas introduced through the housing from the outside is introduced into the mixing pipe and mixed with the air. Therefore, it is possible to improve efficiency in mixing fuel gas and air.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which forms a part hereof. The illustrative embodiments described in the detailed description, drawing, and claims are not meant to be limiting. Other embodiments may be utilized, and other changes may be made, without departing from the spirit or scope of the subject matter presented here.

Hereinafter, a gas mixing apparatus for a boiler according to an exemplary embodiment of the present disclosure will be described in detail with reference to the accompanying drawings.

Figure 1:
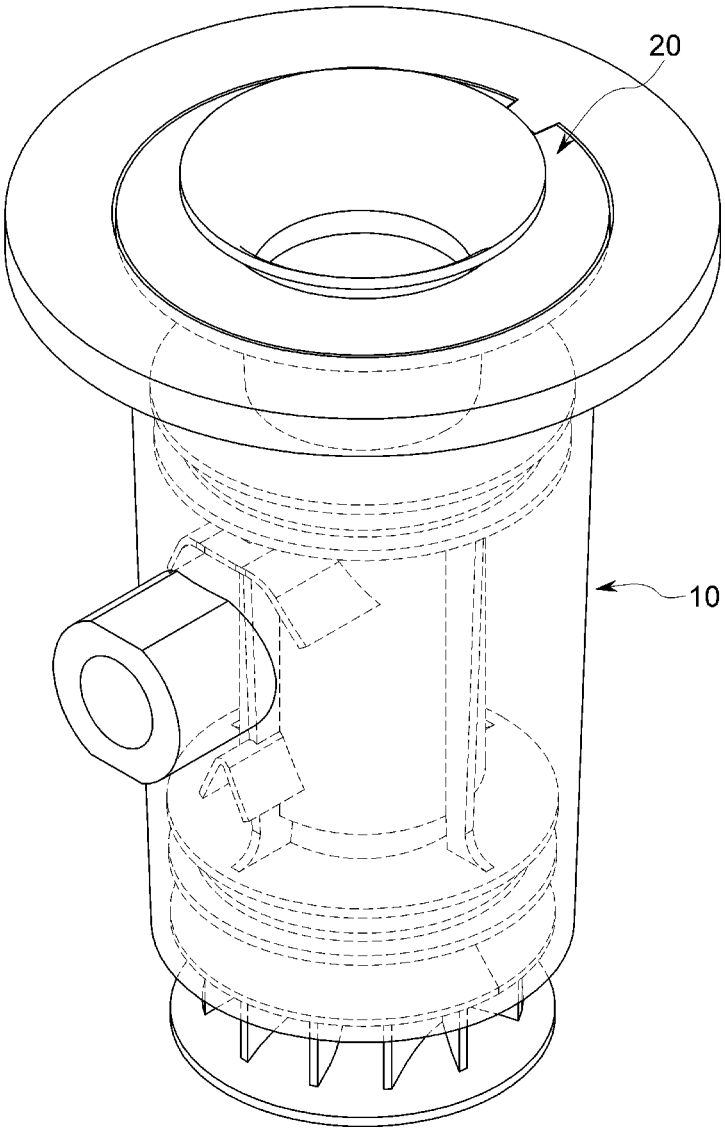
FIG. 1 is a perspective view of a gas mixing apparatus for a boiler according to an exemplary embodiment of the present disclosure.
Figure 2:
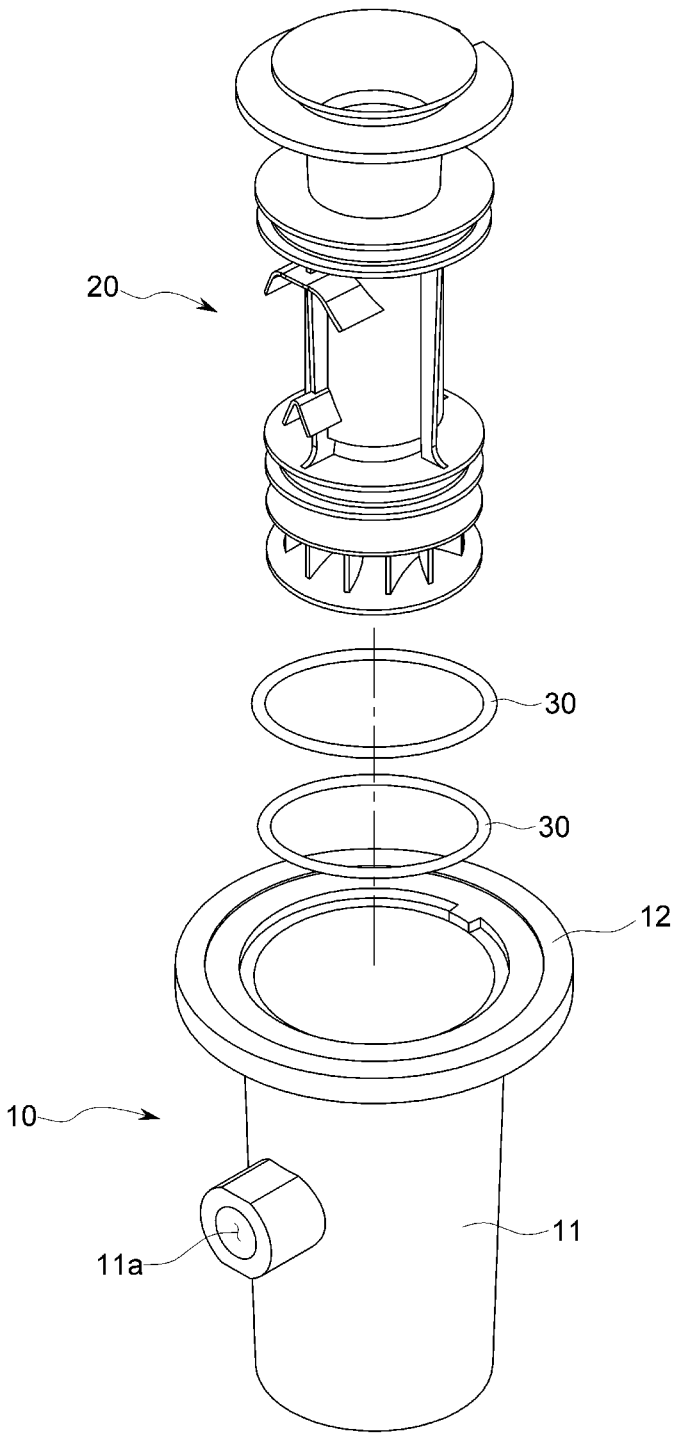
FIG. 2 is an exploded perspective view of FIG. 1.

In the accompanying drawings, FIG. 1 is a perspective view of a gas mixing apparatus for a boiler according to an exemplary embodiment of the present disclosure, and FIG. 2 is an exploded perspective view of FIG. 1.

The gas mixing apparatus for a boiler according to the exemplary embodiment of the present disclosure includes a housing 10 and a mixing pipe 20.

The housing 10 includes a hollow housing body 11 opened at upper and lower sides thereof, and a flange portion 12 extending from an upper end of the housing body 11. The housing body 11 is a portion that surrounds the mixing pipe 20. The housing body 11 is spaced apart from the mixing pipe 20, such that a space in which fuel gas flows is formed between the housing body 11 and the mixing pipe 20. A first gas inlet port 11*a* is provided at a lateral side of the housing body 11, and fuel gas is introduced through the first gas inlet port 11*a* from the outside. The flange portion 12 is a portion to be coupled to another component provided to supply a gas mixture to the gas mixing apparatus according to the present disclosure and a combustion part (burner) of a boiler.

The mixing pipe 20 is provided in the form of a hollow pipe opened at upper and lower sides thereof so that air is introduced through a lower end thereof, and then the air is discharged through an upper end thereof. The mixing pipe 20 is inserted into the housing 10. A second gas inlet port 21*a*, which will be described below, is provided at a lateral side of the mixing pipe 20, and fuel gas is introduced through the second gas inlet port 21*a*, such that the air and the fuel gas are mixed in the mixing pipe 20.

When the housing 10 and the mixing pipe 20 are assembled, the first gas inlet port 11*a* is positioned at a higher position than the second gas inlet port 21*a*.

According to the gas mixing apparatus for a boiler according to the exemplary embodiment of the present disclosure configured as described above, the fuel gas is introduced through the first gas inlet port 11*a* of the housing 10, flows along the space formed between the housing 10 and the mixing pipe 20, and then is introduced into the mixing pipe 20 through the second gas inlet port 21*a*. The air is introduced through the lower end of the mixing pipe 20, flows along the interior of the mixing pipe 20, and then is discharged through the upper end of the mixing pipe 20.

The gas mixture is formed when the fuel gas is mixed with the air while the air flows along the mixing pipe 20. The gas mixture is discharged through the upper end of the mixing pipe 20 and supplied to the combustion part of the boiler.

A process of mixing fuel gas and air will be described below in detail.

Meanwhile, to smoothly mix fuel gas and air, the fuel gas introduced through the first gas inlet port 11*a* of the housing 10 need to be smoothly transmitted to the second gas inlet port 21*a*. To this end, the gas mixing apparatus for a boiler according to the present disclosure has a fluid guide structure configured to guide a flow of fuel gas.

The fluid guide structure will be described below in detail.

Non-described reference numeral 30 indicates an O-ring to be described below.

Figure 3:
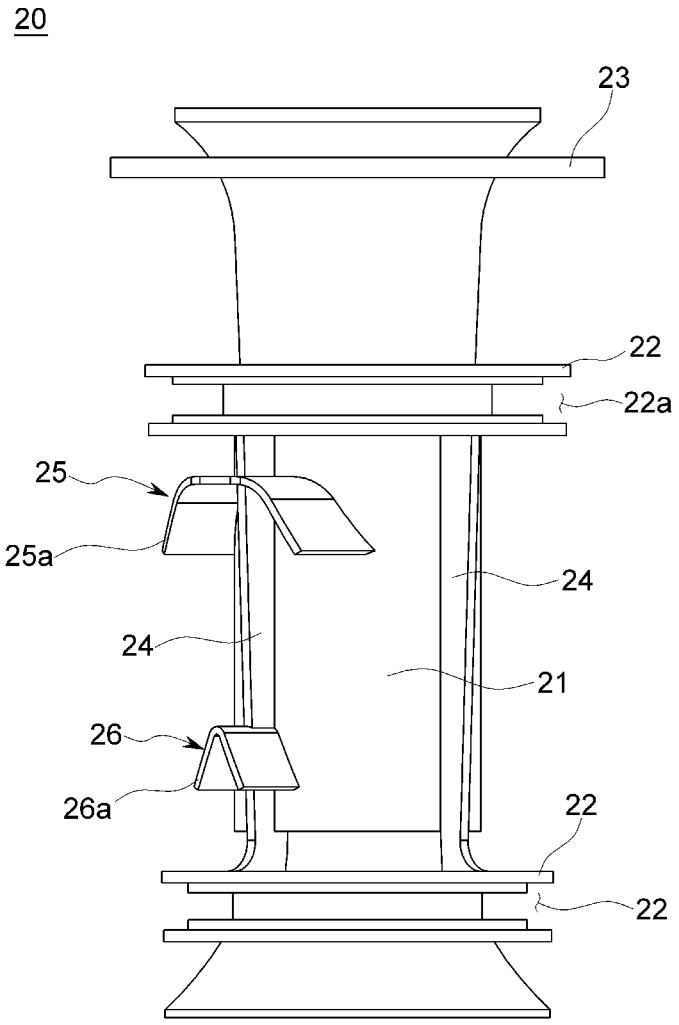
FIG. 3 is a side view of a mixing pipe illustrated in FIG. 2.
Figure 4:
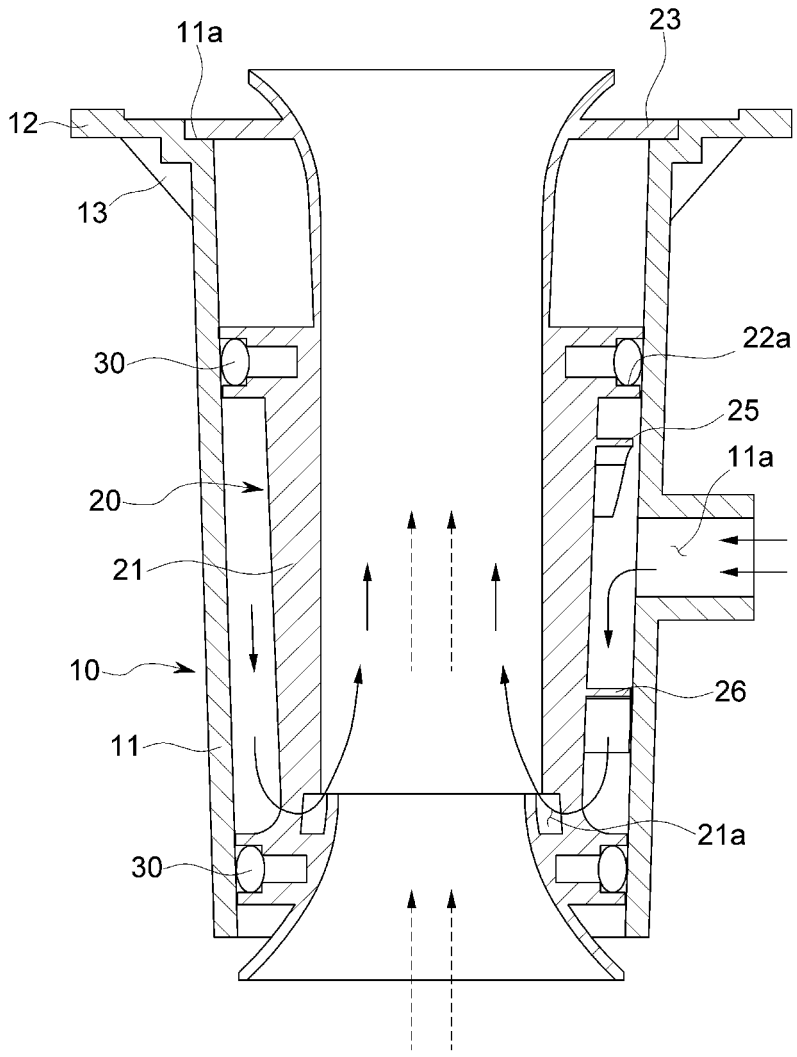
FIG. 4 is a cross-sectional view illustrating a process of mixing fuel gas and air.

In the accompanying drawings, FIG. 3 is a side view of the mixing pipe illustrated in FIG. 2, and FIG. 4 is a cross-sectional view illustrating a process of mixing fuel gas and air.

The mixing pipe 20 includes a pipe body 21, gap maintaining portions 22, a seating portion 23, and fluid guides 24, 25, and 26.

The pipe body 21 is provided in the form of a hollow pipe opened at upper and lower sides thereof. The air is introduced through an opened lower end of the pipe body 21, and the gas mixture is discharged through an opened upper end of the pipe body 21. The pipe body 21 has inlet and outlet portions each having a cross-section that expands toward the end, such that the air may be smoothly introduced, and the gas mixture may be smoothly discharged. A plurality of second gas inlet ports 21*a* is formed at a lateral lower side of the pipe body 21 and spaced apart from one another, so that the fuel gas is introduced into the pipe body 21.

The gap maintaining portions 22 protrude from an outer surface of the pipe body 21 and are spaced apart from one another at an interval in an upward/downward direction, such that the gap maintaining portions 22 maintains an interval between the pipe body 21 and an inner side of the housing 10 when the mixing pipe 20 is inserted into the housing 10. In addition, the O-rings 30, which are sealing members, are fitted into 0-ring fitting grooves 22*a* formed at ends of the gap maintaining portions 22. The O-ring 30 comes into close contact with an inner surface of the housing body 11 when the housing 10 and the mixing pipe 20 are assembled.

The first gas inlet port 11*a*, which is provided on the housing body 11, and the second gas inlet port 21*a*, which is provided on the pipe body 21, are positioned between the two gap maintaining portions 22. Therefore, the fuel gas, which is supplied through the first gas inlet port 11*a* from the outside, flows between the gap maintaining portions 22 and then is introduced into the pipe body 21 through the second gas inlet port 21*a*. Because the gap maintaining portions 22 are sealed by the O-rings 30, the fuel gas introduced between the gap maintaining portions 22 does not leak to the outside.

The seating portion 23 protrudes from an outer upper side of the pipe body 21 and is seated on a seating projection 11*b* formed at an upper inlet side of the housing 10 when the mixing pipe 20 is inserted through an upper portion of the housing 10, thereby restricting the additional insertion of the mixing pipe 20.

The fluid guides 24, 25, and 26 are provided at an outer side of the pipe body 21 and guide the fuel gas to allow the fuel gas to smoothly flow from the first gas inlet port 11*a* to the second gas inlet port 21*a*. The fluid guides 24, 25, and 26 include first, second, and third fluid guides 24, 25, and 26.

The first fluid guide 24 protrudes from the outer surface of the pipe body 21 and is elongated in the upward/downward direction to guide the flow of the fuel gas downward. The first fluid guide 24 is provided as a plurality of first fluid guides 24 spaced apart from one another. The second gas inlet ports 21*a* are provided between lower ends of the adjacent first fluid guides 24. The first fluid guide 24 is spaced apart from the inner surface of the housing body 11. Therefore, the space between the pipe body 21 and the housing body 11 is filled with the fuel gas introduced into the first gas inlet port 11*a*, such that the fuel gas flows in the space. The first fluid guides 24 guide the fuel gas so that the fuel gas, which is present in the space between the two bodies 11 and 21, flows downward toward the second gas inlet ports 21*a*.

The second and third fluid guides 25 and 26 are respectively provided on upper and lower sides of a contact portion of the outer surface of the pipe body 21 with which the fuel gas introduced through the first gas inlet port 11*a* primarily comes into contact. The second and third fluid guides 25 and 26 guide the fuel gas so that a flow of fuel gas is inclined downward. The second fluid guide 25 is provided at the upper side of the contact portion, and the third fluid guide 26 is provided at the lower side of the contact portion.

The second and third fluid guides 25 and 26 respectively have guide surfaces 25*a* and 26*a* inclined downward in a direction from a center toward two opposite sides so that the flow of the fuel gas is inclined downward.

The second fluid guide 25 is relatively wider than the third fluid guide 26. That is, the second fluid guide 25 is formed in a shape that widely surrounds the upper side of the contact portion, and the second fluid guide 25 is formed to be inclined downward toward the two opposite sides, such that the second fluid guide 25 may stably guide the downward inclined flow of the fuel gas introduced from the first gas inlet port 11*a*.

The third fluid guide 26, together with the second fluid guide 25, also guides the downward inclined flow of the fuel gas introduced from the first gas inlet port 11*a*.

In particular, the downward inclined guide surfaces 25*a* and 26*a* of the second and third fluid guides 25 and 26 guide the flow from the fuel gas in an oblique direction, such that the fuel gas introduced from the first gas inlet port 11*a* may surround the pipe body 21 by 360 degrees in a short time and flow while being inclined downward between the pipe body 21 and the housing body 11 and smoothly flow toward the second gas inlet ports 21*a*.

That is, because the fuel gas introduced between the pipe body 21 and the housing body 11 flows along a downward inclined route in the pipe body 21 and the housing body 11, the fuel gas may smoothly flow to a peripheral lower side of the pipe body 21, and a fuel gas may be smoothly introduced through all the second gas inlet ports 21*a*, in comparison with a case in the related art in which no transmission route is determined. Therefore, the fuel gas and the air may be smoothly mixed in the pipe body 21.

The configuration in which the fuel gas is smoothly transmitted to the second gas inlet ports 21*a* by the first, second, and third fluid guides 24, 25, and 26 and the fuel gas and the air are smoothly mixed in the pipe body 21 will be described in detail with reference to an experimental example to be described below.

Meanwhile, the second and third fluid guides 25 and 26 may be integrated with the first fluid guide 24 and the pipe body 21 with the first fluid guide 24 interposed therebetween, such that the positions of the second and third fluid guides 25 and 26 may be stably maintained. That is, the first fluid guide 24 serves as a reinforcement member that reinforces strength of the second and third fluid guides 25 and 26.

Non-described reference numeral 13 indicates reinforcement ribs provided on a bottom surface of the flange portion 12 and at a lateral upper side of the housing body 11. The reinforcement ribs are spaced apart from one another and configured to support the flange portion 12 on the housing body 11.

Figure 5:
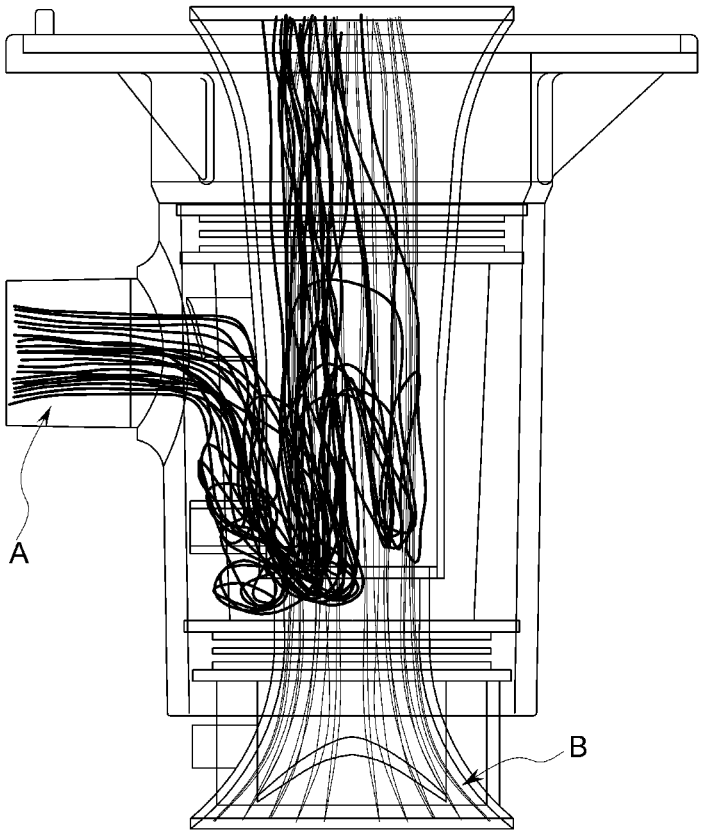
FIGS. 5 and 6A-6B are views illustrating an experimental example in which fuel gas and air are mixed by the gas mixing apparatus for a boiler according to the exemplary embodiment of the present disclosure.
Figure 6A:
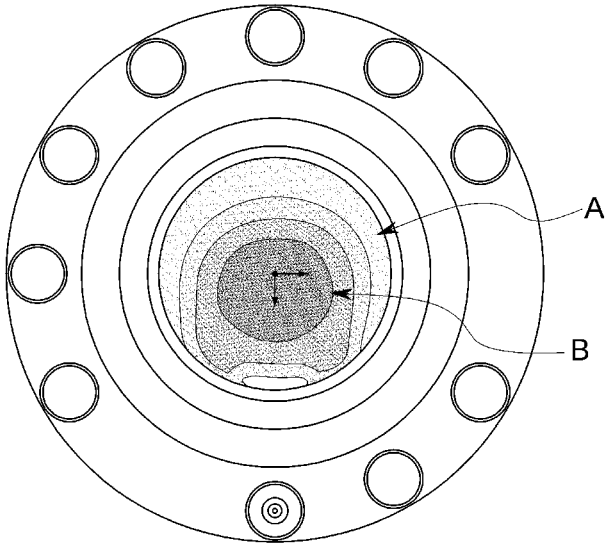
Figure 6B:
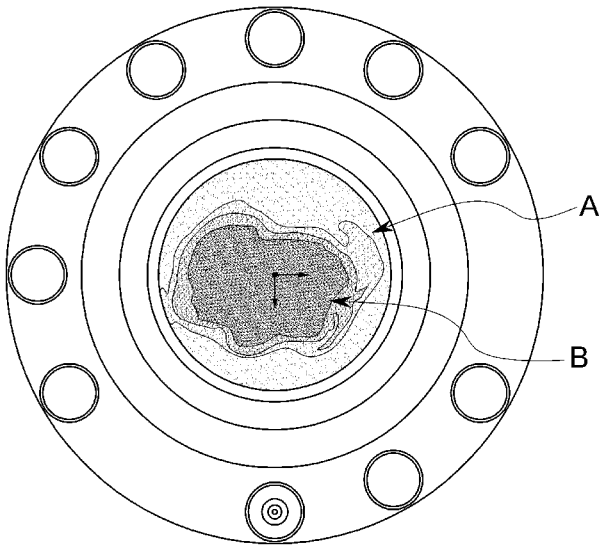
Figure 7:
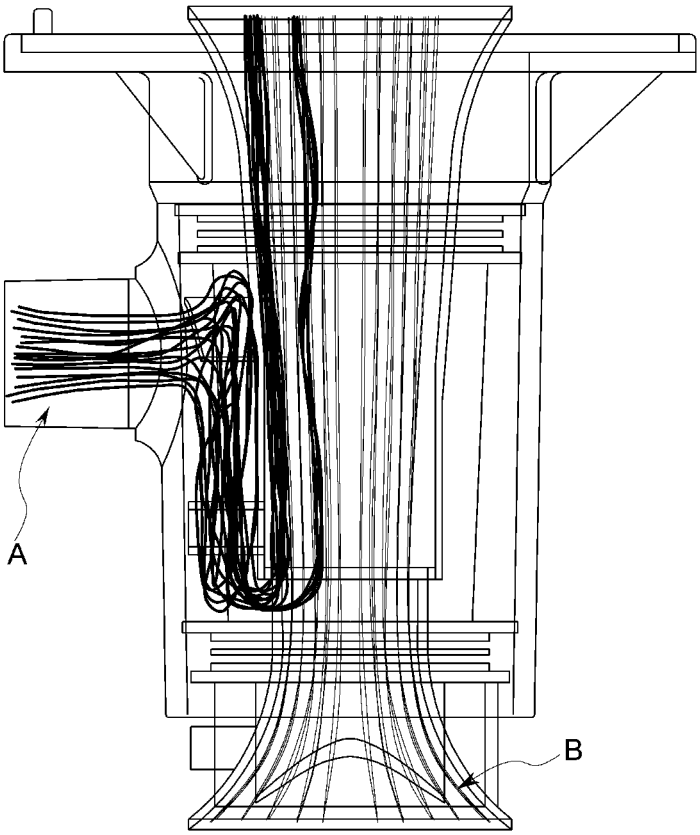
FIGS. 7 and 8A-8B are views illustrating a comparative example in which fuel gas and air are mixed when second and third fluid guides are excluded from the gas mixing apparatus for a boiler according to the exemplary embodiment of the present disclosure.
Figure 8A:
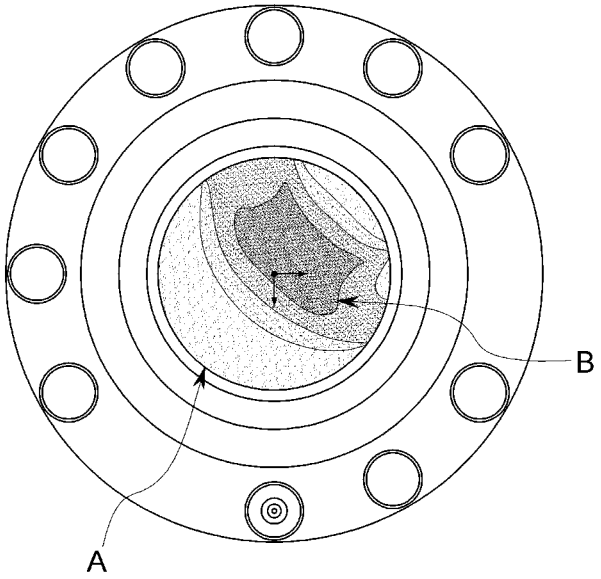
Figure 8B:
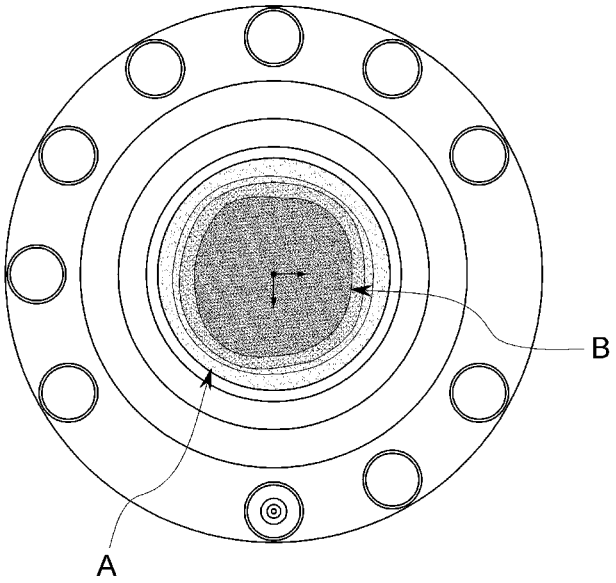

In the accompanying drawings, FIGS. 5 and 6A-6B are views illustrating an experimental example in which fuel gas and air are mixed by the gas mixing apparatus for a boiler according to the exemplary embodiment of the present disclosure, and FIGS. 7 and 8A-8B are views illustrating a comparative example in which fuel gas and air are mixed when second and third fluid guides are excluded from the gas mixing apparatus for a boiler according to the exemplary embodiment of the present disclosure.

Referring to an experimental example in FIG. 5 and a comparative example in FIG. 7, it can be ascertained that the fuel gas introduced between the housing 10 and the pipe body 21 flows downward by means of the first fluid guides 24.

Referring to the experimental example illustrated in FIGS. 5 and 6A-6B and the comparative example illustrated in FIGS. 7 and 8A-8B, it is possible to identify how the second and third fluid guides 25 and 26 affect flow of fuel gas and processes of mixing fuel gas and air. Both the second and third fluid guides 25 and 26 are provided in the experimental example in FIGS. 5 and 6A-6B, whereas both the second and third fluid guides 25 and 26 are not provided in the comparative example in FIGS. 7 and 8A-8B.

In FIGS. 5 and 7, the part shown in thick lines indicates a flow of fuel gas(A), and the part shown in thin lines indicates a flow of air(B). In FIGS. 6A-6B and 8A-8B, the part shown in dark-color indicates a flow of air(B), and the part shown in light-color indicates a flow of fuel gas(A).

Hereinafter, the experimental example and the comparative example will be described in detail.

Experimental Example

As illustrated in FIG. 5, the fuel gas, which is introduced between the housing 10 and the mixing pipe 20 through the first gas inlet port 11*a* of the housing 10, is transmitted to the entire outer section of the mixing pipe 20 while flowing downward in the oblique direction, introduced into the mixing pipe 20 through all the plurality of second gas inlet ports 21*a*, and then transmitted to the upper end of the mixing pipe 20 together with the air.

As illustrated in FIGS. 6A-6B, the fuel gas is mixed with the air while circularly surrounding the air by 360 degrees. It can be ascertained that a flow rate distribution is close to a circular shape in case that a flow rate of fuel gas is high, as illustrated in FIG. 6A. Further, it can be ascertained that a flow of fuel gas is formed closer to a center of a flow of air in case that a flow rate of fuel gas is low, as illustrated in FIG. 6B, in comparison with the case in which a flow rate of fuel gas is high.

It can be ascertained that in case that the second and third fluid guides 25 and 26 are provided as described above, a flow of fuel gas is formed close to a center of a flow of air while entirely surrounding the flow of air. That is, it can be ascertained that the fuel gas is smoothly mixed with the air.

Comparative Example

As illustrated in FIG. 7, the fuel gas, which is introduced between the housing 10 and the mixing pipe 20 through the first gas inlet port 11*a* of the housing 10, flows downward and is transmitted while being concentrated on a part of the mixing pipe 20, i.e., a portion close to the first gas inlet port 11*a*. Then, the fuel gas is introduced into the mixing pipe 20 only through some of the plurality of second gas inlet ports 21*a* and transmitted to the upper end of the mixing pipe 20 together with the air.

It can be ascertained that in case that a flow rate of fuel gas is high, as illustrated in FIG. 8A, a flow rate of the fuel gas is concentrated on a portion positioned close to the first gas inlet port 11*a* in the mixing pipe 20. In addition, it can be ascertained that a flow of fuel gas does not surround a flow of air, and the flow of air is shifted toward one side by being pushed by the flow of fuel gas.

As illustrated in FIG. 8B, a flow of fuel gas surrounds a flow of air in case that a flow rate of fuel gas is low. However, the flow of fuel gas is formed thinly only at a portion adjacent to the inner surface of the mixing pipe 20, and a flow area of air is relatively large.

It can be ascertained that in case that both the second and third fluid guides 25 and 26 are not provided as described above, the fuel gas and the air are not relatively smoothly mixed even in both cases in which the flow rate of fuel gas is high and low, in comparison with the case in which both the second and third fluid guides 25 and 26 are provided.

As described above, there is a great difference in efficiency in mixing fuel gas and air depending on whether the second and third fluid guides 25 and 26 for guiding the flow of fuel gas are provided.

That is, in case that the second and third fluid guides 25 and 26 are provided, the flow of fuel gas is formed to the center of the flow of air while approximately circularly surrounding the flow of air by 360 degrees when the flow rate of fuel gas is high and low, such that the fuel gas and the air may be smoothly mixed.

In contrast, it can be ascertained that in case that the second and third fluid guides 25 and 26 are not provided, the efficiency in mixing fuel gas and air relatively deteriorates in comparison with the case in which the second and third fluid guides 25 and 26 are provided.

While the gas mixing apparatus for a boiler according to the exemplary embodiment of the present disclosure has been described in detail with reference to the accompanying drawings, the present disclosure is not limited to the above-mentioned embodiment and may be variously modified and carried out within the scope of claims. For example, the embodiment of the present disclosure is described as being used for a boiler. However, the present disclosure is not limited thereto but may be applied to other combustion devices in addition to the boiler. Further, the present disclosure may be applied to various processes of mixing gases such as a process of mixing fuel gases in addition to the process of mixing fuel gas and air.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A gas mixing apparatus for a boiler, the gas mixing apparatus comprising:

a housing provided in the form of a hollow pipe opened at upper and lower sides thereof and having a first gas inlet port through which fuel gas is introduced from the outside; and a mixing pipe comprising:

a pipe body provided in the housing and configured to allow air to flow therein, the mixing pipe having a second gas inlet port provided at a lateral side of the mixing pipe and configured to allow the fuel gas to be introduced therethrough; and fluid guides provided at an outer side of the pipe body and configured to guide a flow of the fuel gas from the first gas inlet port to the second gas inlet port, wherein the fluid guides comprise:

a plurality of first fluid guides protruding from an outer surface of the pipe body, elongated in an upward/downward direction, spaced apart from one another, and configured to guide a flow of fuel gas to the second gas inlet port; and a second fluid guide provided at a contact portion of the outer surface of the pipe body with which fuel gas introduced through the first gas inlet port primarily comes into contact, the second fluid guide being configured to guide a flow of the fuel gas to the second gas inlet port.

2. The gas mixing apparatus of claim 1, wherein the first gas inlet port is provided at a higher position than the second gas inlet port, and the first and second fluid guides guide the fuel gas downward to the second gas inlet port.

3. The gas mixing apparatus of claim 2, wherein the pipe body is disposed at an interval from an inner surface of the housing.

4. The gas mixing apparatus of claim 3, wherein the second fluid guide is provided at an upper side of the contact portion, and the fluid guides further comprise a third fluid guide provided at a lower side of the contact portion and configured to guide a flow of the fuel gas downward to the second gas inlet port.

5. The gas mixing apparatus of claim 4, wherein the second gas inlet port is provided at a lateral lower side of the pipe body and provided between the first fluid guides.

6. The gas mixing apparatus of claim 4, wherein the second and third fluid guides each have downward inclined guide surfaces provided at two opposite sides thereof.

7. The gas mixing apparatus of claim 4, wherein the second and third fluid guides are integrated with the first fluid guide and the pipe body with the first fluid guide interposed therebetween.

8. The gas mixing apparatus of claim 3, wherein the mixing pipe further comprises gap maintaining parts protruding from an outer surface of the pipe body and spaced apart from each other at an interval in an upward/downward direction, and the gap maintaining parts maintain an interval between the pipe body and an inner side of the housing.

9. The gas mixing apparatus of claim 8, wherein an O-ring fitting groove is formed at an end of the gap maintaining part, and an O-ring, which is in close contact with the inner surface of the housing, is fitted into the O-ring fitting groove.

10. The gas mixing apparatus of claim 8, wherein the first and second gas inlet ports are positioned between the gap maintaining parts.

* * * * *